US008328445B2

(12) United States Patent
Martins et al.

(10) Patent No.: US 8,328,445 B2
(45) Date of Patent: Dec. 11, 2012

(54) PACKAGE WITH A REFILL CARTRIDGE, A REFILL CARTRIDGE AND AN OUTER ENVELOPE

(75) Inventors: Paula Renata Martins, Vila Madalena (BR); Fabiana Tomas Pelliciari, Jundiai (BR)

(73) Assignee: Natura Cosmeticos S.A., Itapecerica da Serra, SP (BR)

( * ) Notice: Subject to any disclaimer, the term of this patent is extended or adjusted under 35 U.S.C. 154(b) by 681 days.

(21) Appl. No.: 12/516,589

(22) PCT Filed: Nov. 29, 2007

(86) PCT No.: PCT/BR2007/000326

§ 371 (c)(1),
(2), (4) Date: Nov. 30, 2009

(87) PCT Pub. No.: WO2008/064448

PCT Pub. Date: Jun. 5, 2008

(65) Prior Publication Data

US 2010/0078344 A1 Apr. 1, 2010

(30) Foreign Application Priority Data

Nov. 29, 2006 (BR) ..... 0604978

(51) Int. Cl.
*B43K 21/08* (2006.01)

(52) U.S. Cl. ..... 401/78; 401/77

(58) Field of Classification Search ..... 401/75–78
See application file for complete search history.

(56) References Cited

U.S. PATENT DOCUMENTS

| | | | | |
|---|---|---|---|---|
| 3,623,821 | A | 11/1971 | Gould | |
| 4,505,607 | A | 3/1985 | Sugiyama | |
| 4,666,324 | A | 5/1987 | Oses | |
| 5,399,040 | A | 3/1995 | Holloway | |
| 5,649,777 | A | 7/1997 | Holloway | |
| 6,217,243 | B1 * | 4/2001 | Monin-Bareil | 401/98 |

FOREIGN PATENT DOCUMENTS

| | | |
|---|---|---|
| FR | 2 696 328 | 4/1994 |
| GB | 686 985 | 2/1953 |
| GB | 687 064 | 2/1953 |
| GB | 731 013 | 6/1955 |
| GB | 1599960 | 10/1981 |

* cited by examiner

*Primary Examiner* — David Walczak
(74) *Attorney, Agent, or Firm* — B. Aaron Schulman, Esq.; Stites & Harbison PLLC

(57) ABSTRACT

A package with a refill cartridge for baton shaped products, such as lipsticks and face bases. The package comprises an outer envelope comprising a cap and a body portion, from the base of which the inner axial protrusion extends, and a refill cartridge to be fitted into the base of the outer envelope. The refill cartridge comprises two tubular walls that cooperated to raise and lower the baton-shaped product for the application to the user. The end of the second tubular wall of the cartridge is folded inwards and upwards so as to form a holding surface that receives the axial protrusion and keeps it motionless.

11 Claims, 6 Drawing Sheets

PACKAGE WITH A REFILL CARTRIDGE, A REFILL CARTRIDGE AND AN OUTER ENVELOPE

FIELD OF THE INVENTION

The present invention relates to a package for cosmetics, especially for lipsticks or other pasty baton-shaped products, wherein the baton-shaped product is arranged in a refill cartridge. The present invention also relates to an outer envelope and to the refill cartridge that composes such a package.

DESCRIPTION OF THE PRIOR ART

Pasty cosmetic products such as lipsticks, concealers and face foundations are generally shaped into cylindrical sticks and packed into tubular packages. An end of the cylindrical stick is inserted into a movable cup-shaped base arranged within a tubular body, such a base being raised to expose the stick out of the body during application of the product. Since the baton-shaped product may become dry when exposed to air, the tubular body further receives a cap.

The tubular body comprises at least two concentric and juxtaposed tubular walls, the raising and retraction of the body base being carried out by means of a relative torque between these two walls. The outermost concentric wall has a thread-shaped slot and the other tubular wall has two straight slots that extend axially. The cub-shaped base has two fixation pins; when the base is arranged between the two walls the pins pass through the straight slots and fit into the helical slot. When one of the walls is turned, the pins are forced upwards, and the base is raised. Turning the wall in the opposite direction forces the pin downwards, thus retracting the base.

As it happens with every package that aims at conquering the attention and preference of the consumer, the outer part of the tubular body and its respective cap are designed so as to facilitate the handling thereof and, at the same time, they are adorned so as to become esthetically plea-sing.

This concern with the external aspect of the tubular body ends up raising the final cost of the cosmetic. Additionally, since the baton-shaped product is consumed in a relatively rapid way, this same tubular body is disposed after the product has finished, even though it would have the necessary robustness and resistance to be reused repeatedly.

In order to prevent this waste and, at the same time, lower the cost of the baton-shaped product, a few manufacturers have opted for developing packages in which the pasty product is sold in simple refills that can be arranged in reusable tubular bodies.

Document GB 687.064, for instance, shows a lipstick package where the baton-shaped product is provided in a refill that is fixed to the reusable envelope by means of a thread connection. The product is packed in a cylindrical refill, and such refill is threaded onto a cup-shaped base, which is fixed to the reusable envelope. The mechanism responsible for raising and retracting the cup-shaped base is a part of the reusable envelope, the refill comprising only a threaded base, where the baton is arranged.

On the other hand, GB 686.985 shows a somewhat different configuration where the refill end comprises a second cup that is fixed to the movable cup of the reusable envelope. According to the same principle of the above document, the mechanism responsible for raising and retracting the movable cup of the envelope is a part of the reusable envelope.

The package configurations described in these two prior-art documents have a number of drawbacks. Since the mechanism is a part of the tubular body, it is necessary for the connection between it and the refill to be perfect in order to enable the package to function (which requires complex configurations, like a threaded connection). In addition, this type of configuration requires more handling of the cartridge, since fixing it to the envelope is not an operation of mere insertion.

In an attempt to solve such problems, a number of packages were developed, where the mechanism responsible for axially raising and retracting the cup-shaped base that carries the pasty product is included in the product refill itself. The inventions of documents GB 731,013, U.S. Pat. No. 3,623,821, U.S. Pat. No. 4,505,607 and U.S. Pat. No. 5,399,040, for example, show different ways of fixing the refill cartridge with such a mechanism to an outer envelope:

- GB 731,013 shows a lipstick package where the refill, having the mechanism responsible for moving the cup-shaped base, is inserted into a base piece of the envelope. This insertion is effected by fitting a shoulder on the cartridge sidewall into a groove in the outer wall of a socket inserted into the package base. In order to guarantee the correct positioning of the cartridge and guarantee the absence of relative movement between the latter and the package, the side wall of the cartridge base is provided with grooves and shoulders that fit into corresponding shoulders and grooves provided on the socket of the package base;
- U.S. Pat. No. 3,623,821 proposes the use of a metallic sleeve (see FIGS. 3 and 5) that fastens the refill cartridge to the base of the reusable envelope. This metallic sleeve has an annular shoulder on its outer side wall, which fits into a corresponding groove in the base of the reusable envelope. The concavity produced by this shoulder on the inner side wall of the sleeve receives shoulder portions present on the side wall of the cartridge, fastening it. In this way, the metallic sleeve engages with both the cartridge and the envelope base.
- U.S. Pat. No. 4,505,607 describes the engagement between a refill cartridge and a reusable package body, wherein the package has a hexagonal protrusion and the cartridge has a hexagonal opening that receives such a protrusion. The walls of the protrusion are inclined and end in a shoulder that is superimposed on the end plate of the inner tube of the cartridge, where the hexagonal opening is formed (see FIG. 2, reference numbers 19 and 20). The polygonal configuration of the opening and of the protrusion helps to prevent relative movement between the two parts, and the shoulder present at the end of the protrusion functions as a fixing stop for the end plate of the inner tube. Additionally, the envelope base has a step to receive the lower end of the outer tube of the cartridge; and
- U.S. Pat. No. 5,399,040 shows a package with removable cartridge, where the cartridge comprises a base element, a cosmetic holder (cartridge) having an inner tube and an outer tube, and retention means. The base element has a toothed inner wall for corresponding engagement at the base of the inner tube of the cartridge, and the retention means has a protrusion for engagement with the base element and with the inner tube of the cartridge.

These known procedures, however, are either too simple to the point of not guaranteeing the correct fixation of the refill to the reusable body, or are extremely complex, requiring the use of auxiliary parts for correct fixation and functioning of the package.

In this regard, the inventions described in documents GB 731,013 and U.S. Pat. No. 4,505,607, for example, show constructions that do not guarantee an adequate fixation between the cartridge and the reusable envelope. In the GB document, the fixation between the cartridge and the reusable envelope is made by a simple slot-and-shoulder connection or by simple pressure. On the other hand, in the US document, the connection is made by inserting a protrusion of the base into an opening in the inner tube of the cartridge and by fitting the lower end of the outer tube into a step of the reusable envelope. Since the contact between the protrusion and the cartridge is limited to the border of the opening, a secure connection is not achieved. Thus, in the packages of these documents, any abrupt movement might cause the cartridge to detach from the envelope.

The inventions described in documents U.S. Pat. No. 3,623,821 and U.S. Pat. No. 5,399,040, in turn, show complex configurations where a number of parts are required for a more secure and functional connection. In this regard, document '821 proposes the use of a sleeve to guarantee an adequate connection between the cartridge and the reusable envelope. This sleeve is fitted over the outer envelope, fixing the cartridge to it. On the other hand, document '040 shows a package where the cartridge is coupled to the outer envelope by means of a base member and a retention means.

The base member has an engagement portion for engagement with a corresponding portion of the cartridge and the retention means has a protrusion for engagement with the cartridge and a base for engagement with the base member. The need for additional parts in the packages proposed in documents U.S. Pat. No. 3,623,821 and U.S. Pat. No. 5,399,040 ends up making the manufacture thereof complex, raising the cost of the final product, which is already high due to the larger number of parts. In addition, the fact that the adequate functioning is based on cooperation between the various auxiliary parts makes this type of package more liable to failures and requires more care on the part of the user during use and packaging.

OBJECTIVES OF THE INVENTION

The main objective of the present invention is to provide a package for baton-shaped pasty products, where the baton-shaped product is arranged in a refill cartridge to be fitted into a reusable outer envelope where the refill cartridge can be manipulated even before being fitted into the reusable outer envelope.

An additional objective of the present invention is to provide a package for pasty baton-shaped products that is inexpensive and functions efficiently.

Another objective of the present invention is to provide a refill cartridge for a package for paste baton-shaped products that is easy and economical to manufacture.

A further objective of the present invention is to provide an outer envelope for a package for paste baton-shaped products that is easy and economical to manufacture.

SUMMARY OF THE INVENTION

The present invention achieves these and other objectives by means of a package with a refill cartridge for baton-shaped products, which comprises an outer envelope having a cap and a tubular body portion closed by a base, the base of the outer envelope having an inner axial protrusion; and a cartridge comprising two concentric and juxtaposed tubular walls, one of the tubular walls comprising a helical slot and the other of the walls comprising an axial straight slot, and a movable retainer for retaining a baton-shaped product arranged within the walls and having fixation means that passes between the wall slots, and comprising a handling cap.

The axial protrusion of the outer envelope comprising axial grooves that divide one end into a number of protrusions and it is formed integrally with the base of the envelope, where the lower end of one of the walls is folded inwards and upwards to define a holding surface that receives the internal axial protrusion of the outer envelope, so that a rotation movement imposed on the outer envelope is passed on to the wall that is folded inwardly and upwardly, and the relative rotation between this wall and the other tubular wall raises and retracts the movable retainer and the handling cap is fixed between the walls and comprises inner and outer grooves.

In a preferred embodiment of the present invention, the tubular wall that comprises the axial straight slot has a diameter smaller than the wall that comprises the helical slot, and the tubular wall that is folded inwards and upwards is the wall that comprises the axial straight slot.

The wall that comprises the axial straight slot may comprise a second axial slot diametrically opposed to the first axial slot, and in this case the movable retainer has a second fixation means that passes through the second axial slot.

In a further embodiment, the body portion of the outer envelope includes a counterweight made of a material heavier than the envelope material.

The wall with the helical slot may have an extent shorter than the wall having a straight slot, and a handling cap may be arranged on the lower end of this wall and be engaged from beneath the end of the other tubular wall.

The refill cartridge may further comprise a third tubular wall, external and concentric to the other tubular walls and made of a material that is more robust than the material of the other walls.

In a preferred embodiment, the upper end of the axial protrusion of the outer envelope comprises axial grooves that divide said end into a number of protrusion portions.

The refill cartridge may further comprise a cap to be arranged over the tubular walls, covering the baton-shaped product.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
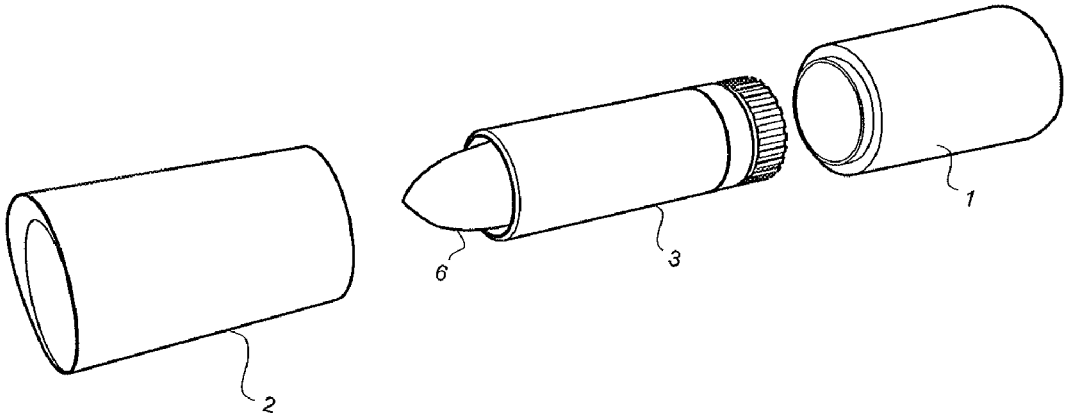
FIG. 1 is a perspective exploded view of a package with a refill according to the present invention.

FIG. 1 shows a package with a refill for baton-shaped products composed by a reusable outer envelope comprising a body portion 1 and a cap 2, and a refill cartridge 3 that receives the baton-shaped product 6.

Figure 2:
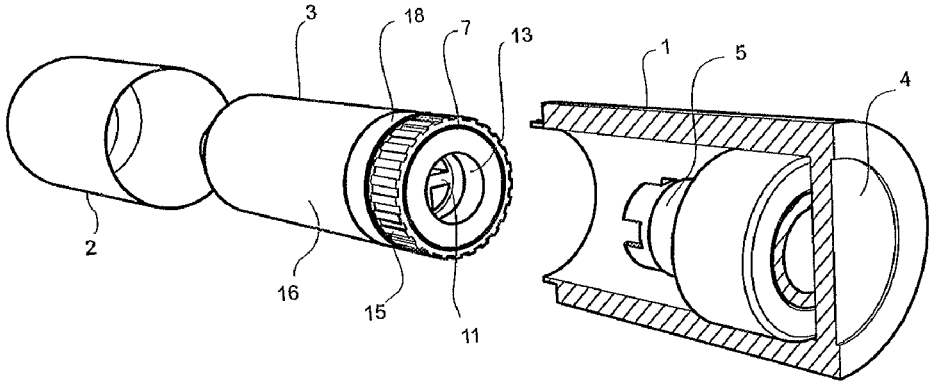
FIG. 2 is a perspective rear exploded view of a package with a refill according to the present invention, showing the body portion of the outer envelope in cross section.
Figure 3:
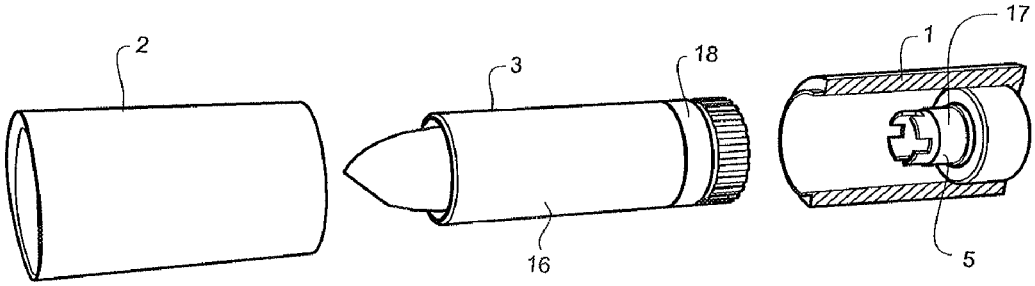
FIG. 3 is a perspective front exploded view of a package with a refill according to the present invention, showing the body portion of the outer envelope in cross section.

As shown in FIGS. 2 and 3, the tubular body portion 1 comprises a base 4. The base 4 has an internal axial protrusion that projects over a length shorter than the length of the body portion 1. As can be seen in the hatched region of FIG. 2, the protrusion 5 is integral with the inner surface of the base 4.

The refill cartridge 3 receives the baton-shaped product 6. As shown in FIG. 2, the refill cartridge 3 has preferably a tubular configuration.

The cartridge comprises two concentric and juxtaposed tubular walls 7, 8 and a movable retainer 11, which receives the baton-product. The movable retainer 11 functions as a raiser that receives the baton-shaped product and moves it upwards and downwards, so as to expose it when using the package.

Figure 4:
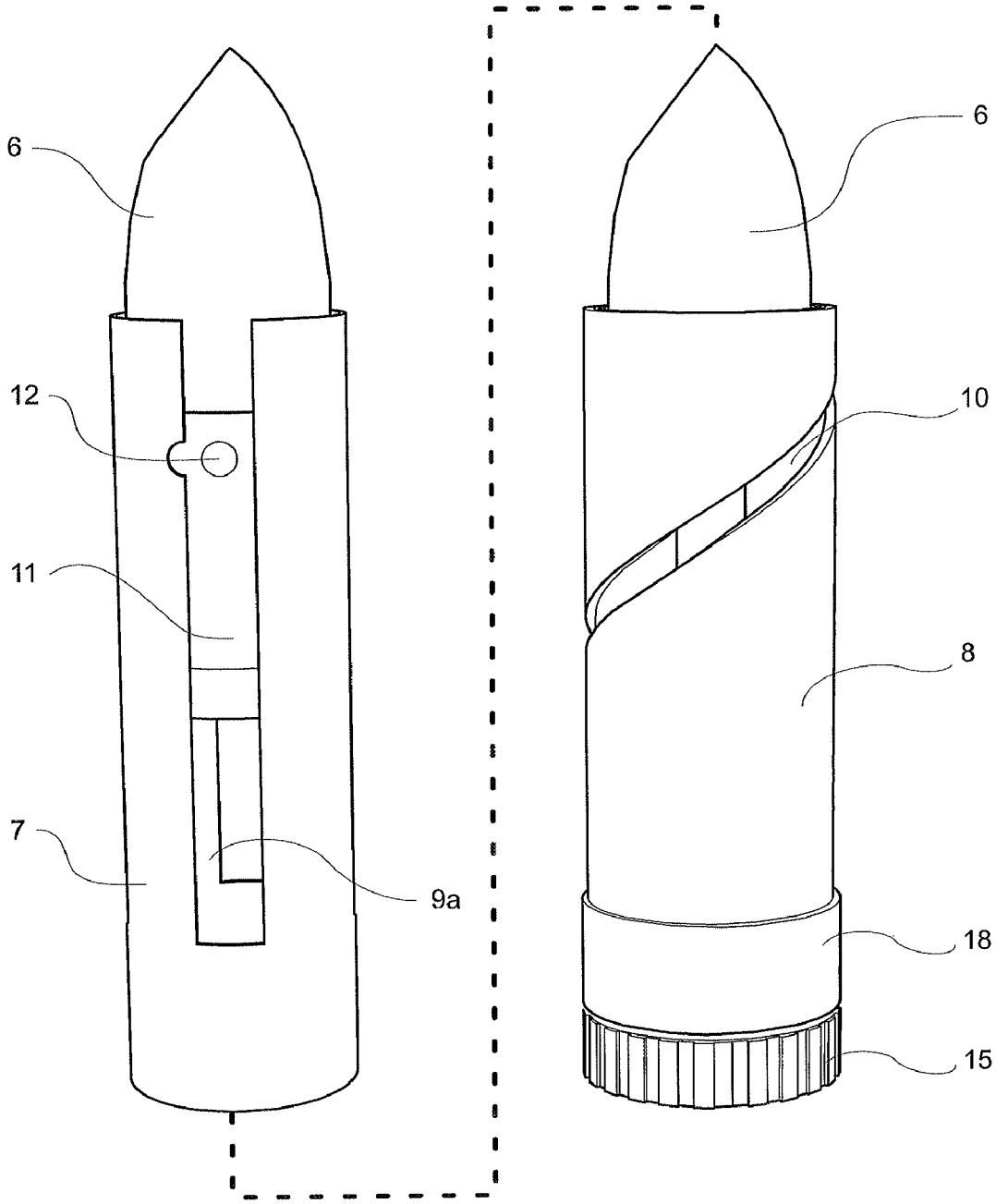
FIG. 4 is a view illustrating separately the two concentric and juxtaposed tubular walls of the refill cartridge that composes the package according to the present invention.

FIG. 4 illustrates the mechanism responsible for conferring movement to the retainer 11. The drawing on the left of FIG. 4 shows the cartridge without the first tubular wall 8 and without the handling cap 15. On the other hand, the drawing on the right shows the cartridge with the first tubular wall 8 and the handling cap 15 (the function of the handling cap 15 will be better explained later).

The second tubular wall 7 of smaller diameter has two axial slots 9*a*, 9*b*, which extend over a considerable part of its axial extent, and the first tubular wall 8 has a helical slot 10.

The movable retainer 11 is inserted into the structure formed by the two tubular walls 7 and 8 and has fixation pins 12, which are inserted through the slots 9*a*, 9*b* and fit into the helical slot 10.

As those skilled in the art know, the relative rotation movement between the tubular walls 7 and 8 forces the pins 12 so that the movable retainer 11 is raised or lowered according to the rotation direction.

Although the illustrated embodiment shows the presence of two straight slots and a single helical slot, one should understand that any combination of slots, as for example, a straight slot and a helical one, would provide the desired movement of the retainer 11. Obviously, if the second tubular wall 7 had only one slot, the retainer 11 would have to exhibit one fixation pin 12. Besides, although the illustrated embodiment shows a fixation pin, any radial protrusion or equivalent fixation means would equally be applicable to the present invention.

Figure 5:
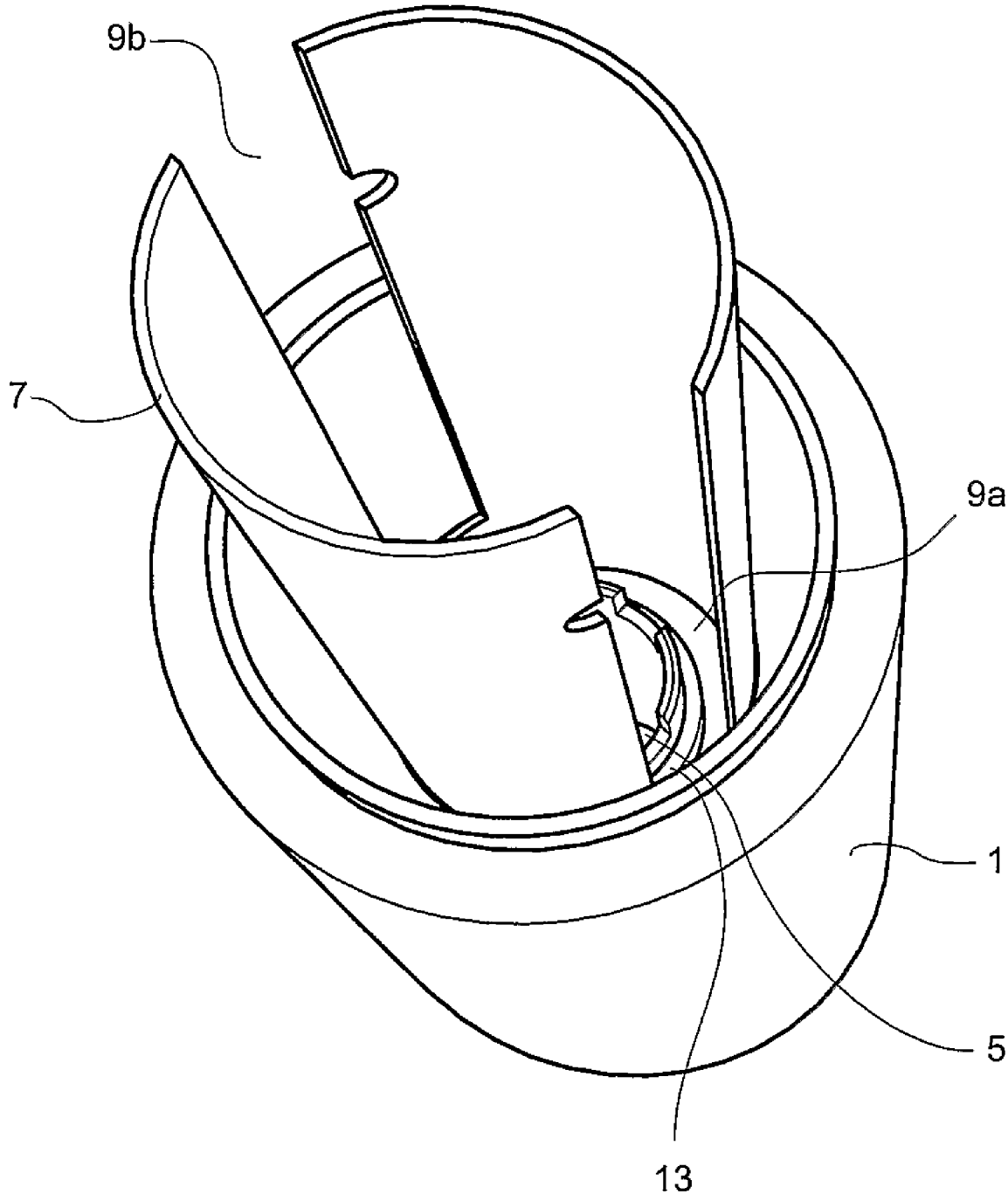
FIG. 5 is a cross-sectional view showing details of the outer envelope and of one of the tubular walls of the refill cartridge that composes the package according to the present invention.
Figure 7:
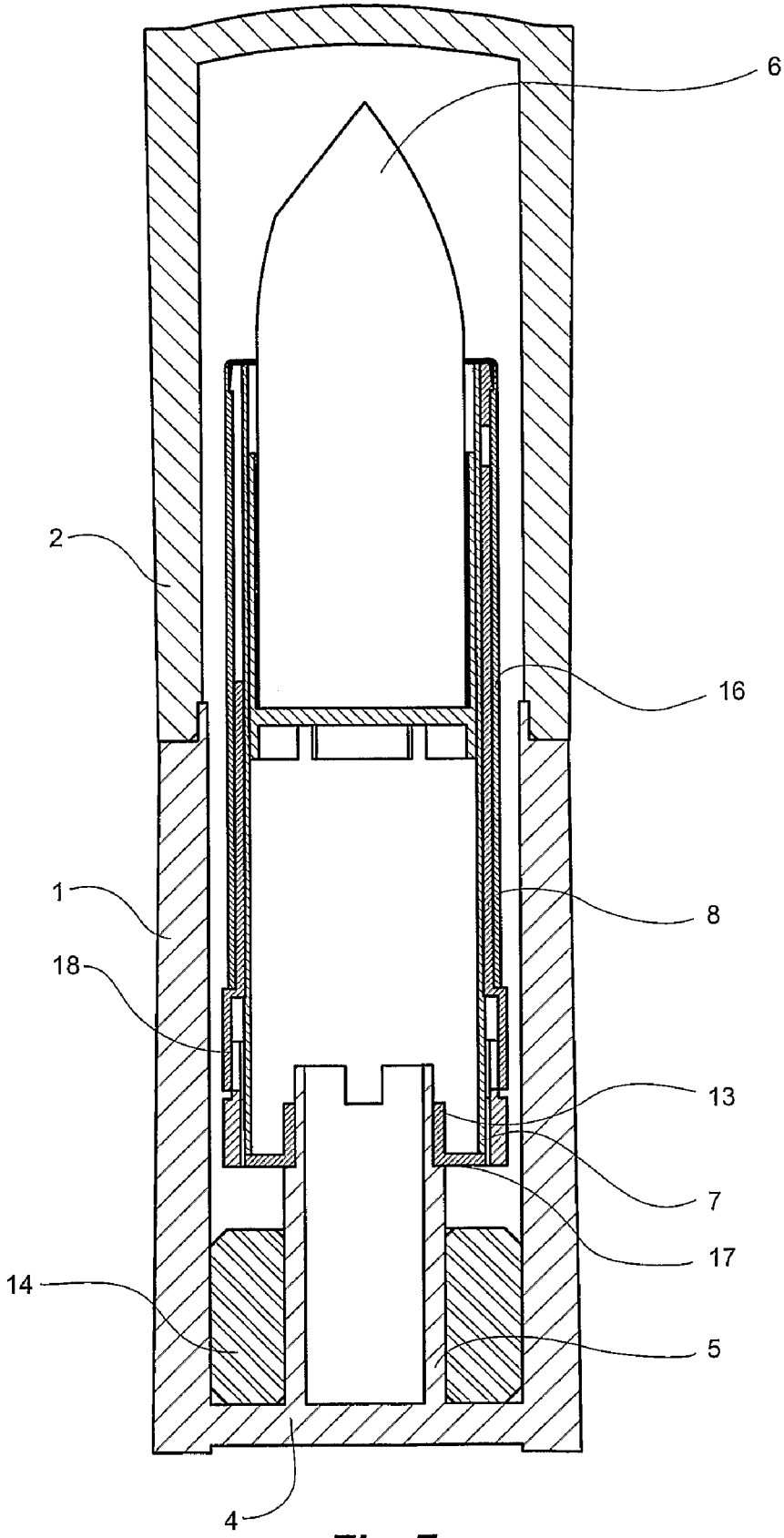
FIG. 7 is a cross-sectional view showing details of the package with refill cartridge according to the present invention.

As better illustrated in FIGS. 5 and 7, the lower end of the second tubular wall 7 is folded inwards and upwards so as to form a holding surface 13. In a preferred embodiment, this surface 13 has a tubular profile and is parallel to the tubular walls 7 and 8.

For fitting the refill cartridge 3 into the body portion 1 of the outer envelope, the protrusion 5 is received by the holding surface 13, the pressure exerted between the latter and the protrusion keeps them relatively motionless (without relative motion). In this way, any rotation movement imposed on the body portion 1 can be transferred to the second tubular wall 7, moving the retainer 11 and exposing or retracting the baton-shaped product 6.

In this regard, one should understand that the essential movement to move the retainer is the relative movement between the tubular walls 7 and 8. Thus, even if the illustrated embodiment shows a cartridge where the second tubular wall 7 with the straight slots 9*a*, 9*b* is turned, an analogous functioning would be achieved if the first tubular wall 8 were the movable one. In this case, it would be the first tubular wall 8 that would end in a part folded upwards and downwards and would receive the protrusion 5 of the body portion 1.

Figure 6:
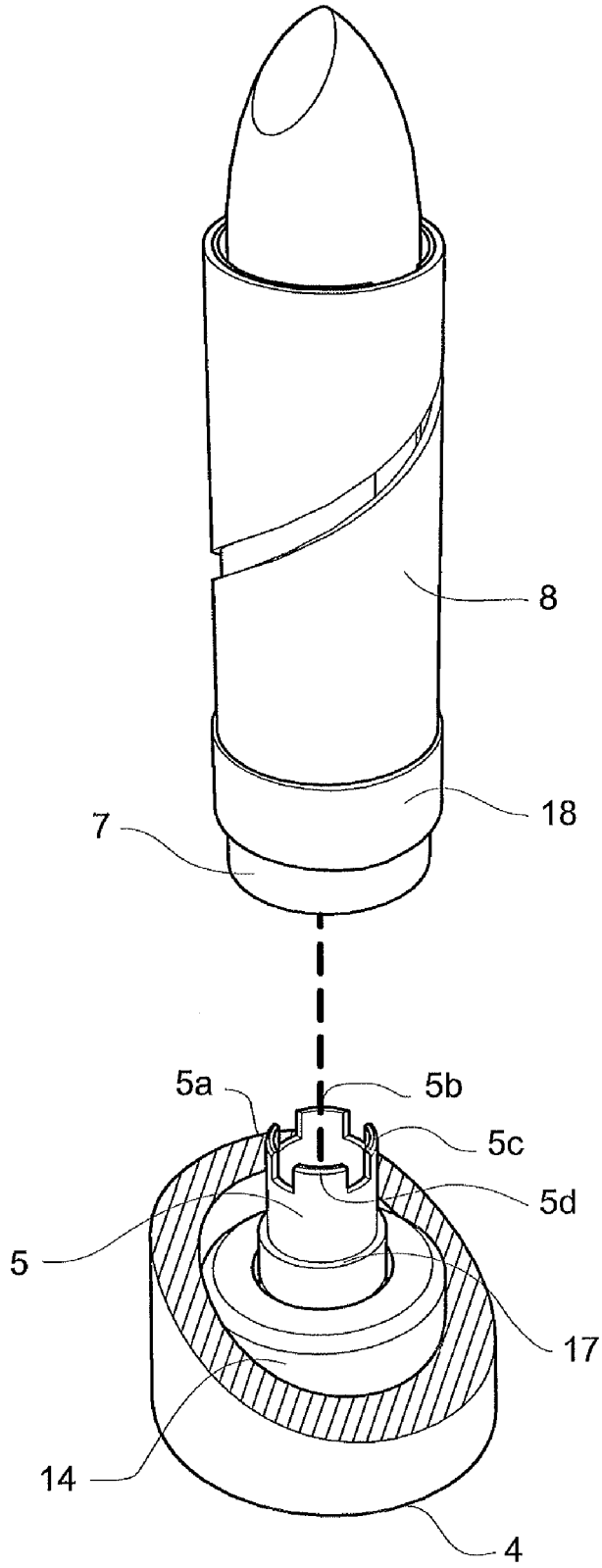
FIG. 6 is a view showing the fitting between the refill cartridge and the outer envelope that composes the package according to the present invention.

FIG. 6 shows a schematic illustration of the fitting between the refill cartridge 3 and the body portion 1 of the reusable envelope. The lower end of the second tubular wall 7 is folded inwards and upwards, so as to form a holding surface 13, which receives the axial protrusion of the body portion of the reusable envelope. In order to facilitate the insertion of the protrusion and guarantee correct fixation thereof after is has been inserted, the upper end of the protrusion 5 may comprise axial grooves that divide it into a number of protrusion portions 5*a*, 5*b*, 5*c*, 5*d*. These portions, which are four in number in the figure, confer flexibility to the protrusion 5, so that, upon insertion of the cartridge, they aid it to enter into the folded end of the second tubular wall 7 and, when the cartridge is already in the inserted position, they guarantee its maintenance therein.

As will be understood by those skilled in the art, the axial protrusion may further comprise other grooves or shoulders that aid in its engagement with the holding surface 13 or with the cartridge tubular walls 7, 8. However, the contact between the protrusion 5 and the holding surface 13 is the main responsible for preventing relative movement between the refill cartridge 3 and the envelope and fixing adequately the cartridge to the body portion, enabling the adequate functioning of the package.

As can be observed in FIGS. 6 and 7, the protrusion 5 may further comprise a stop wall 17, which limits the position of the refill cartridge 3 during its insertion into the body portion 1.

In the preferred embodiment illustrated in the figures, the body portion further includes a counterweight 14 made of a material heavier than the envelope material. This counterweight 14, which in the illustrated embodiment takes on the shape of a metallic ring, maintains the stability of the body portion 1 and makes its use by the user more pleasant. In addition, this counterweight surrounds the protrusion 5, making it more resistant to lateral movement.

Further in the preferred embodiment, the second tubular wall 7 has a shorter length than the first tubular wall 8, and a handling cap 15 is arranged over the lower portion of the second tubular wall 7.

Figure 8:
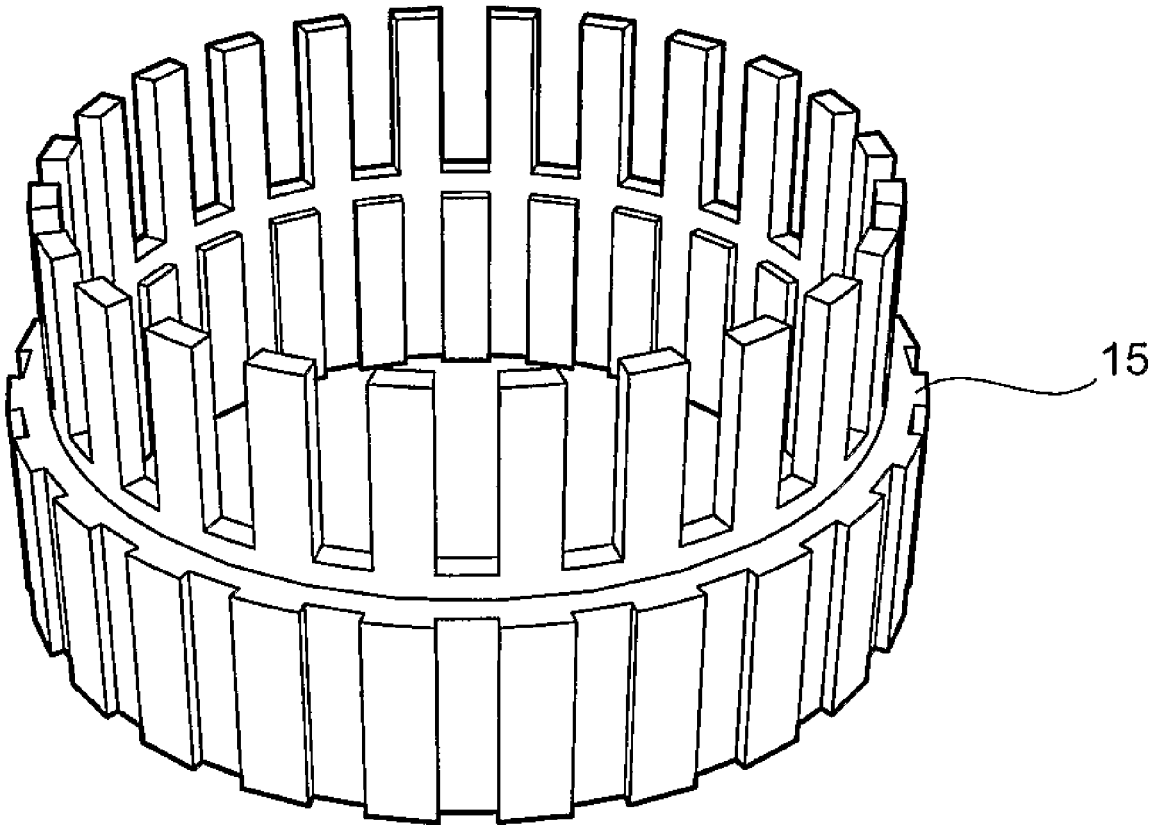
FIG. 8 is a perspective view showing the handling cap that composes one of the embodiments of the refill cartridge of the present invention.

As shown in FIGS. 2, 4 and 8, this handling cap 15 is shaped like a tube and may have outer and inner grooves. This cap 15 facilitates the "grip" of the second tubular wall 7, enabling, for instance, easy rotation of this wall, even before the cartridge is inserted into the body portion 1 of the envelope. In addition, the cap 15 may be sized so that it will be adjacent the body portion 1 of the envelope upon insertion of the cartridge into the envelope. In this way, the cap 15 has the additional function of aiding in the fitting between the cartridge and the envelope, by the pressure exerted between the two parts upon this insertion. The fixation of the cap 15 is effected by inserting the upper end of the cap 15 between the second tubular wall 7 and the first tubular wall 8. In this regard, as shown in FIGS. 4 and 7, the first tubular wall 8 may comprise a lower end of a slightly larger diameter 18, so as to facilitate the insertion of the upper end of the cap 15.

In the embodiment illustrated, the cartridge further comprises a third tubular wall 16, which is external and concentric with the tubular walls 7 and 8. This third tubular wall is made from a material that is more robust than the material of the other tubular walls and may be used for adorning the cartridge or even to provide a structural reinforcement thereof.

The cartridge may further comprise a cap, to be inserted over the third tubular wall. The cap prevents the baton-shaped product from drying, conferring durability and enabling commercialization thereof separately.

The package whose preferred embodiment has been described above has, as a major advantage, simplicity, being simple and economical to manufacture and easy to use. The cooperation between the axial protrusion 5 formed directly on the base 4 of the outer envelope and the holding surface 13, formed when folding the tubular wall 13 inwards and upwards, enables perfect functioning of the package with refill cartridge, without the need for complex fitting structures and additional parts.

The optional and additional characteristics described as part of the preferred embodiment aim at providing additional advantages or at making the use of the package more pleasing to the user. However, one should understand that the real scope of the invention is defined in the accompanying claims.

The invention claimed is:

1. A package with a refill cartridge for baton-shaped products, the package comprising:

(a) an outer envelope having a cap and a tubular body portion closed by a base, the base of the outer envelope having an inner axial protrusion comprising axial grooves dividing an end of the inner axial protrusion into a number of protrusion portions; the inner axial protrusion formed integrally with the base of the outer envelope, and (b) a refill cartridge comprising:

(b1) two concentric and juxtaposed tubular walls, a first tubular wall having an end and comprising a helical slot, and a second tubular wall having a lower end and comprising two diametrically opposed axial straight slots; the lower end of the second tubular wall being folded inwards and upwards defining a holding surface, the holding surface receiving the inner axial protrusion of the outer envelope;

(b2) a movable retainer for retaining a baton-shaped product arranged inside the concentric and juxtaposed tubular walls, and having fixation means passing between the two diametrically opposed slots of the second tubular wall and the helical slot of the first tubular wall, and (b3) a handling cap having an upper end comprising inner and outer grooves, wherein the handling cap is fixed between the second tubular wall and first the tubular wall, by inserting the upper end of the handling cap between the second tubular wall and the first tubular wall.

2. A package with a refill cartridge for baton-shaped products according to claim 1, wherein the second tubular wall comprising the two diametrically opposed axial straight slots has a diameter smaller than the first tubular wall comprising the helical slot.

3. A package with a refill cartridge for baton-shaped products according to claim 1, wherein the body portion of the outer envelope further includes a counterweight made of a material that is heavier than the envelope material.

4. A package with a refill cartridge for baton-shaped products according to claim 1, wherein the handling cap is arranged over the lower end of the second tubular wall and is fitted from beneath the end of the first tubular wall.

5. A package with a refill cartridge for baton-shaped products according to claim 1, wherein the refill cartridge further comprises a third tubular wall, which is external and concentric with the first and second tubular walls.

6. A package with a refill cartridge for baton-shaped products according to claim 1, wherein the handling cap is sized to be adjacent to the body portion of the envelope.

7. A refill cartridge for a package for baton-shaped products, the refill cartridge comprising:

(i) two concentric and juxtaposed tubular walls, a first tubular wall comprising an end and a helical slot and a second tubular wall comprising a lower end and two diametrically opposed axial straight slots;

(ii) a movable retainer for retaining a baton-shaped product arranged within the two concentric and juxtaposed tubular walls and having fixation means passing between the two diametrically opposed slots of the second tubular wall and the helical slot of the first tubular wall;

(iii) a handling cap having an upper end comprising inner and outer grooves, and (iv) a third tubular wall external and concentric with the first and second tubular walls;

wherein the handling cap is fixed between the second tubular wall and the first tubular wall by inserting the upper end of the handling cap between the second tubular wall and the first tubular wall.

8. A refill cartridge for a package for baton-shaped products according to claim 7, wherein the second tubular wall comprising the two diametrically opposed axial straight slots has a diameter smaller than the first tubular wall comprising the helical slot.

9. A refill cartridge for a package for baton-shaped products according to claim 7, wherein the handling cap is arranged over the lower end of the second tubular wall and is fitted from beneath the end of the first tubular wall.

10. A refill cartridge for a package for baton-shaped products according to claim 7 further comprising a cap to be arranged over the tubular walls, covering the baton-shaped product.

11. Envelope refill cartridge for a package for baton-shaped products according to claim 7, further comprising an outer envelope having a body portion, wherein the body portion further has a counterweight made of a material heavier than the outer envelope material.

* * * * *